US009610605B2

(12) United States Patent
Jensen et al.

(10) Patent No.: US 9,610,605 B2
(45) Date of Patent: Apr. 4, 2017

(54) METHOD FOR COLD GAS SPRAYING OF A LAYER HAVING A METAL MICROSTRUCTURE PHASE AND A MICROSTRUCTURE PHASE MADE OF PLASTIC, COMPONENT HAVING SUCH A LAYER, AND USE OF SAID COMPONENT

(75) Inventors: Jens Dahl Jensen, Berlin (DE); Oliver Stier, Berlin (DE); Raymond Ullrich, Schönwalde (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 682 days.

(21) Appl. No.: 13/701,134

(22) PCT Filed: May 20, 2011

(86) PCT No.: PCT/EP2011/058286
§ 371 (c)(1),
(2), (4) Date: Nov. 30, 2012

(87) PCT Pub. No.: WO2011/151205
PCT Pub. Date: Dec. 8, 2011

(65) Prior Publication Data

US 2013/0078450 A1 Mar. 28, 2013

(30) Foreign Application Priority Data

May 31, 2010 (DE) ..... 10 2010 022 593

(51) Int. Cl.
*B05D 1/12* (2006.01)
*C23C 24/04* (2006.01)
(Continued)

(52) U.S. Cl.
CPC ..... *B05D 1/12* (2013.01); *B22F 3/115* (2013.01); *B22F 7/04* (2013.01); *C22C 32/0094* (2013.01); *C23C 24/04* (2013.01); *Y10T 428/254* (2015.01)

(58) Field of Classification Search
CPC ..... C23C 24/00; B05D 1/12
(Continued)

(56) References Cited

U.S. PATENT DOCUMENTS 8,198,783 B2 6/2012 Bayer et al.
2007/0042218 A1 2/2007 Lang et al.
(Continued)

FOREIGN PATENT DOCUMENTS

AT 511434 A4 12/2012
CN 101432902 5/2009
(Continued)

OTHER PUBLICATIONS

International Search Report for PCT/EP2011/058286, mailed on Nov. 7, 2011.
(Continued)

*Primary Examiner* — Humera Sheikh
*Assistant Examiner* — Lucas Wang
(74) *Attorney, Agent, or Firm* — Slayden Grubert Beard PLLC

(57) ABSTRACT

In a method for cold gas spraying a layer, coating particles are accelerated in a cold spraying nozzle. The particles have a plastic encapsulation. In said manner, the plastic is precipitated onto the substrate together with the metal material, thereby forming in particular layer compositions having good sliding properties, dirt repellent properties, or lubricating properties. The coating can be used as a bearing component of a sliding bearing, as a flow component, in particular as a rotor blade of wind power plants or body
(Continued)

components of transportation vehicle, or as trim components of structures.

6 Claims, 2 Drawing Sheets

(51) Int. Cl.
*B22F 3/115* (2006.01)
*B22F 7/04* (2006.01)
*C22C 32/00* (2006.01)

(58) Field of Classification Search
USPC ..... 427/201
See application file for complete search history.

(56) References Cited

U.S. PATENT DOCUMENTS

| | | | | |
|---|---|---|---|---|
| 2009/0202814 | A1 | 8/2009 | Jabado et al. | |
| 2009/0252986 | A1* | 10/2009 | Owen et al. | 428/623 |
| 2009/0256010 | A1* | 10/2009 | Golna et al. | 239/589 |
| 2009/0278423 | A1* | 11/2009 | Bayer et al. | 310/340 |
| 2010/0098845 | A1* | 4/2010 | Jensen | C23C 4/12 427/185 |
| 2010/0297345 | A1 | 11/2010 | Jensen et al. | |
| 2011/0039024 | A1 | 2/2011 | Jabado et al. | |

FOREIGN PATENT DOCUMENTS

| | | | |
|---|---|---|---|
| DE | 19959515 | A1 | 6/2001 |
| DE | 10300966 | B4 | 5/2007 |
| DE | 102006019900 | | 11/2007 |
| DE | 102006021260 | | 11/2007 |
| DE | 102006047101 | | 4/2008 |
| DE | 102007046386 | | 10/2008 |
| DE | 102008023569 | | 11/2009 |
| DE | 10 2010 022 593.2 | | 5/2010 |
| EP | 1707650 | | 10/2006 |
| EP | 1237662 | B1 | 3/2009 |
| WO | 01/42525 | A2 | 6/2001 |
| WO | 2007/033936 | | 3/2007 |
| WO | 2007/125059 | | 11/2007 |
| WO | 2009/073196 | | 6/2009 |
| WO | PCT/EP2011/058286 | | 5/2011 |

OTHER PUBLICATIONS

Chinese Office Action for related Chinese Patent Application No. 201180027024.0, issued Dec. 23, 2013, 16 pages.

* cited by examiner

METHOD FOR COLD GAS SPRAYING OF A LAYER HAVING A METAL MICROSTRUCTURE PHASE AND A MICROSTRUCTURE PHASE MADE OF PLASTIC, COMPONENT HAVING SUCH A LAYER, AND USE OF SAID COMPONENT

CROSS REFERENCE TO RELATED APPLICATIONS

This application is based on and hereby claims priority to International Application No. PCT/EP2011/058286 filed on May 20, 2011 and German Application No. 10 2010 022 593.2 filed on May 31, 2010, the contents of which are hereby incorporated by reference.

BACKGROUND

The invention relates to a process for cold spraying a layer on a substrate, in which process coating particles are accelerated with a convergent-divergent nozzle in a cold gas jet and deposited on the substrate. In this case, the produced layer has a metallic first microstructure phase made of a metal or a metal alloy and a second microstructure phase made of a plastic.

A process and also a component of the type indicated in the introduction are known, for example, from US 2007/0042218 A1. The process employed to produce this layer is a cold spraying process. In this case, particles of a metal forming the matrix of the layer microstructure and also inter alia particles of a plastic which are to form a soft phase in the matrix are processed together by the cold spraying process. The finished layer then has a closed matrix of the metal, in which the individual particles of the soft phase made of plastic can be identified.

SUMMARY

One potential object is to specify a process for producing a layer having a metallic first microstructure phase and a second microstructure phase made of plastic, with which a relatively large number of different materials can be processed and the fill level of plastic in the produced layer can be set in a relatively large range.

The inventors propose a process in which use is made of coating particles which include a material forming the metallic microstructure phase and are provided with an encapsulation made of plastic. Accordingly, no individual plastic particles are thus used, but rather the plastic which is to form the second microstructure phase is bonded firmly to the metallic particles to be processed. This has the advantage that the plastic, which has a significantly lower density than the metal of the particles, bonds firmly to the metallic particles. Therefore, the plastic is also similarly accelerated in the cold spraying process and benefits from the high impact velocity which the metal particles having the significantly higher density achieve. A less problematic deposition of plastic in the layer to be formed is thereby advantageously possible. This is different to the situation where, as in US 2007/0042218 A1 mentioned in the introduction, it is fed separately as particles to the cold gas jet, and can be accommodated in the metallic microstructure of the layer only up to a certain limit concentration. In addition, the plastic particles drop from the surface to be coated and are not incorporated therein. The coating particles present can in this case themselves include a metal alloy, this then being deposited substantially in the composition of the particles in the layer. However, the coating particles can also be mixed from different metals, with an alloy then being formed during the layer formation process, a subsequent heat treatment or during use.

According to an advantageous configuration, it is provided that the plastic used is a thermoplastic fluoropolymer, in particular PTFE (Teflon) and/or PFA and/or PFEP and/or FTFE and/or ECTFE and/or PVDF. Thermoplastic fluoropolymers advantageously have particularly good sliding properties, nonstick properties and hydrophobic properties, and are therefore outstandingly suitable, for example, as dry lubricants. In addition, these polymers are also relatively thermally stable, up to 400° C. depending on the composition. They have a very high chemical resistance. These properties can also be utilized in a composite material, as is represented by the coating. Thus, for example, it is possible to produce nickel-PTFE composite coatings having the microstructure composition indicated above.

According to a further configuration, it is provided that the coating particles have a mean particle diameter of at least 5 μm and at most 10 μm, preferably at least 7 μm and at most 8 μm, measured without the encapsulation. In this respect, it has emerged that metallic particles of this size can be deposited by cold spraying without any problems. On the other hand, they still have a size which is small enough for a fine distribution of the second microstructure phase made of plastic to be produced. The advantages indicated above can thus be utilized to the best possible extent.

A further configuration of the process provides that the coating particles are coated with the base material before they are fed to the nozzle or to a stagnation chamber arranged upstream thereof. Particles which can be prepared by specialist suppliers are therefore processed by the cold spraying. By way of example, PTFE dispersions (for coating) and powder are supplied by Dyneon (3M). The nature of the particles can advantageously be determined precisely, as a result of which the cold spraying can advantageously be carried out with particularly consistent layer results.

It is advantageously also possible, however, for the coating particles to be fed without an encapsulation to the nozzle or to a stagnation chamber arranged upstream thereof, and at the same time for a dispersion of plastic particles (described in DE 10 2006 047 101 A1) to be supplied, wherein the plastic particles accumulate on the coating particles before the latter come into contact with the substrate. In this case, the liquid which forms the dispersion with the plastic particles evaporates, such that merely the plastic particles remain adhering to the coating particles and thus form the encapsulation thereof. In this respect, the plastic particles should preferably have smaller dimensions than the coating particles of which they become part by accumulation. The plastic particles are preferably nanoparticles. These can advantageously be processed particularly effectively as a dispersion. The advantage of carrying out the coating process with plastic dispersions is that a relatively large variety of different material compositions can be processed, without this requiring an increased storage of prefabricated particles. Suitable dispersions for plastics are, for example, dispersions containing PTFE nanoparticles, which are sold, for example, by Dyneon and are known under the trade names PTFE 5032R, PTFE 5035R and PTFE 5050R.

In order to provide the coating particles with the encapsulation made of plastic even before processing by cold spraying, the coating particles can be ground, for example, with PTFE powder, wherein the particles of the plastic accumulate on the coating particles. Suitable for this purpose is, for example, the micropowder TF 9205 PTFE having a particle size of 8 μm, as is sold by Dyneon. However, in this case the coating particles also have to be larger, so that accumulation of the plastic particles with a high yield is possible.

The object indicated above is furthermore achieved by a component in which the second microstructure phase made of plastic is formed as a cohesive network in the layer. This is made possible by the fact that the second microstructure phase made of plastic is applied as an encapsulation of the coating particles forming the first microstructure phase made of metal. A very fine distribution of the plastic in the microstructure of the produced layer is thereby advantageously possible.

It is otherwise advantageous if the first metallic microstructure phase is formed as a cohesive matrix, wherein the matrix of the metallic microstructure phase and the network of the second microstructure phase made of plastic penetrate one another in any case. The spatial structures are therefore present interlocked in one another. This has the advantage that a solid cohesion of the first metallic microstructure phase is ensured if the second microstructure phase made of plastic simultaneously has a fine distribution.

Which spatial structure the microstructure phases in the layer have depends primarily on the parameters for the production of the layer. If the layer is produced on the component by cold spraying, it is possible, for example, for the kinetic energy with which the coating particles are sprayed to be varied. If this turns out to be relatively low, the coating particles do not deform to such a great extent when they come into contact with the component, and therefore the encapsulation is largely retained and thus forms a cohesive network which at least still largely surrounds the coating particles. The first metallic microstructure phase forming from the coating particles is therefore substantially not cohesive.

In order to produce the first metallic microstructure phase as a cohesive matrix, it is possible to increase the kinetic energy with which the coating particles are processed. As a result of this, the plastic of the encapsulation is displaced to a greater extent when the coating particles come into contact with the component or, on account of the high local increase, also partially evaporates, such that adjacent metallic coating particles cake together and as a result a cohesive matrix is formed overall. However, sufficient plastic material of the encapsulation still remains, for example outside the zone of contact of the particles, such that this too can form a cohesive network.

A further possible way of influencing the layer composition and the formation of the microstructure phases is to modify the thickness of the encapsulation. The thinner the encapsulation, the lesser the incorporation of plastic in the microstructure of the layer and the greater the likelihood that a cohesive matrix of the first metallic microstructure phase also forms. On the other hand, this is prevented if the encapsulation of the coating particles is formed with a greater thickness.

The component can advantageously be used as a bearing component of a plain bearing. In this case, the layer on the component can fully deploy its outstanding dry lubricating properties.

Another use of the component is as a flow component. This means components around which a liquid or gaseous medium in particular flows. In this case, the layer is advantageous, since it reduces the tendency of ice or dirt to adhere, the formed surfaces are easy to clean and also the wear is reduced as a result of reduced friction caused, for example, by abrasive particles, since the surface of the layer has outstanding tribological properties. Finally, the risk of corrosion under environmental influences is also reduced, because raindrops, for example, drip off and therefore no local elements which would promote pitting corrosion, for example, can form. Possible flow components which can be mentioned are rotor blades of wind power plants and also body parts of means of transportation. The term "means of transportation" in this respect is to be understood broadly. Vehicles, aircraft, boats and also trains are equally intended thereby.

The use of the component as a cladding component, in particular of structures, such as for example as a façade element, is also advantageous. It is thereby possible to produce façades which are easy to clean and which rarely or even never have to be freed of dirt. Here, too, it is possible to reduce a tendency of the cladding components to corrode.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
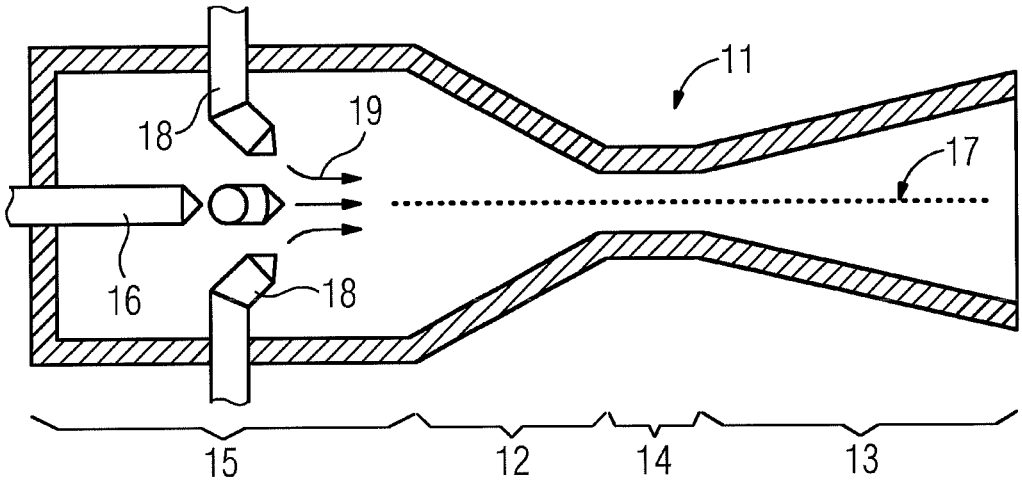
FIG. 1 shows an exemplary embodiment of the proposed process and also a modified cold spraying nozzle suitable therefor having a stagnation chamber.

Reference will now be made in detail to the preferred embodiments of the present invention, examples of which are illustrated in the accompanying drawings, wherein like reference numerals refer to like elements throughout.

The proposed cold spraying process can be carried out using a cold spraying nozzle 11 as shown in FIG. 1. This has a convergent portion 12 and a divergent portion 13 and a throat 14. Such a nozzle is referred to as a convergent-divergent nozzle. The convergent portion 12 of the cold spraying nozzle 11 is connected to a stagnation chamber 15, into which various feed tubes issue.

Figure 3:
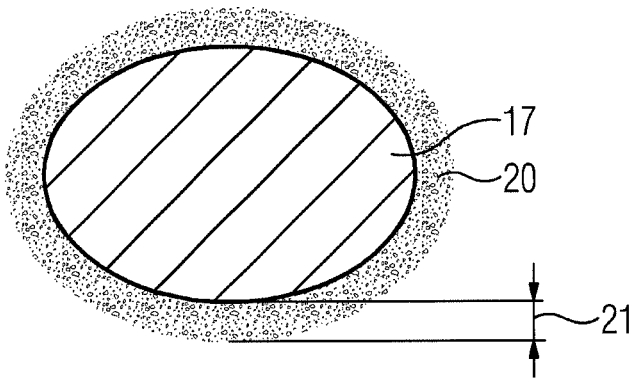

A particle feed tube 16 for coating particles 17 issues into the stagnation chamber centrally. Furthermore, a ring of suspension feed tubes 18 is arranged in the stagnation chamber, through which a suspension, including a suspension agent, for example water, and plastic particles, can be introduced into the stagnation chamber in the direction of the arrows 19 indicated. The dispersion mixes with the coating particles 17, such that the plastic particles 20 can be accumulated on the coating particles 17 and thereby form an encapsulation 21 (FIG. 3).

Figure 2:
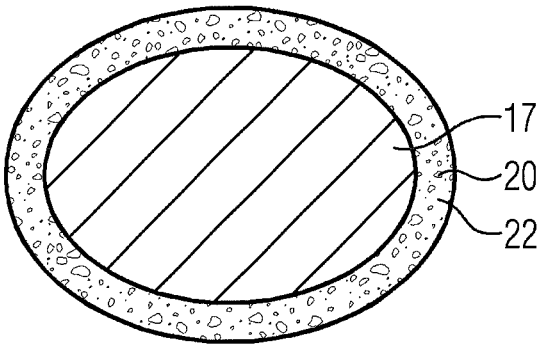
FIGS. 2 and 3 show exemplary embodiments of coating particles, as can be used in the process, as cross sections.

Beforehand, however, the coating particle 17, as can be gathered from FIG. 2, is firstly wetted by the dispersion 22 containing the plastic particles 20. However, the dispersion agent evaporates fairly quickly at the latest after the cold gas jet has eased in the divergent part 13 of the nozzle 11, such that the particles 17 with the encapsulation 21 made of the plastic particles 20 remain. The plastic particles 20 have dimensions in the nanometer range, whereas the metallic fractions of the coating particles 17 have a mean diameter of approximately 8 μm.

Figure 4:
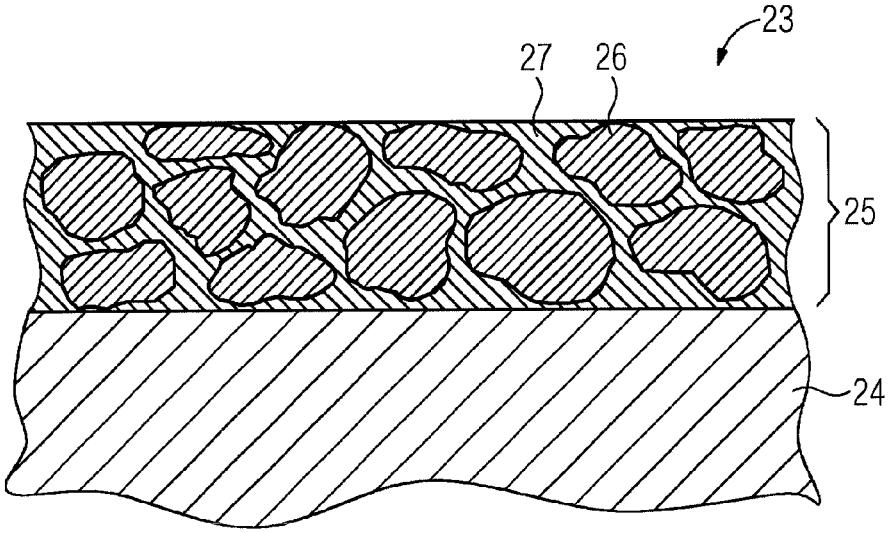
FIGS. 4 and 5 show exemplary embodiments of the component having the layer proposed by the inventors, as partial sections.

A component 23 as shown in FIG. 4 includes a substrate 24, on which a layer 25 is deposited. The layer 25 has a first microstructure phase made of metal 26, which is embedded in a second microstructure phase 27 made of plastic. The microstructure phase 27 made of plastic therefore forms a cohesive network in the layer 25.

Figure 5:
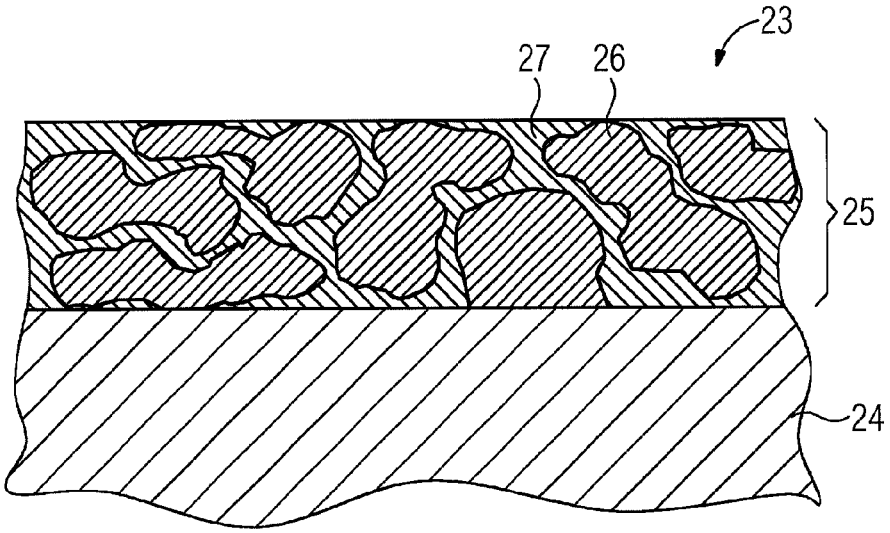

In the case of the component 23 shown in FIG. 5, the layer 25 has a somewhat different structure. Here, the coating particles form a cohesive matrix, such that the first metallic microstructure phase 26 also provides a cohesive network. This is penetrated by the network of the second microstructure phase 27 made of plastic, such that the two microstructure phases are interlocked, so to speak, or in other words are interwoven with one another.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2 1865 (Fed. Cir. 2004).

The invention claimed is:

1. A process for cold spraying a substrate, comprising:

feeding metallic coating particles to a convergent-divergent nozzle device, the metallic coating particles being fed without a plastic encapsulation;

supplying a dispersion, comprising a liquid suspension agent and plastic particles dispersed in the liquid suspension agent, to the nozzle device while the metallic coating particles are being fed to the nozzle device, the plastic particles being smaller than the metallic coating particles;

accelerating the metallic coating particles with the nozzle device in a cold gas jet, while allowing the plastic particles to accumulate on the coating particles, thereby forming plastic encapsulated coating particles before the metallic coating particles contact the substrate; and depositing the encapsulated coating particles on the substrate to from a layer having a metallic first microstructure phase and a second microstructure phase made of a plastic.

2. The process as claimed in claim 1, wherein the metallic coating particles and the dispersion of plastic particles are fed to a stagnation chamber at an upstream end of the nozzle device.

3. The process as claimed in claim 1, wherein the plastic is a thermoplastic fluoropolymer.

4. The process as claimed in claim 1, wherein the plastic particles are formed from at least one plastic selected from the group consisting of polytetrafluoroethylene (PTFE), perfluoroalkoxy (PFA), fluorinated ethylene propylene (FEP), ethylene-tetrafluoroethylene (ETFE), ethylene chlorotrifluoroethylene (ECTFE) and polyvinylidene fluoride (PVDF).

5. The process as claimed in claim 1, wherein the metallic coating particles have a mean particle diameter of at least 5 μm and at most 10 μm, measured without plastic encapsulation.

6. The process as claimed in claim 1, wherein the metallic coating particles have a mean particle diameter of at least 7 μm and at most 8 μm, measured without plastic encapsulation.

* * * * *